United States Patent [19]

Senn

[11] Patent Number: 4,754,784

[45] Date of Patent: Jul. 5, 1988

[54] LOOM HAVING A SUPPORTING AND ADJUSTING DEVICE FOR WARP YARN GUIDANCE

[75] Inventor: Georg Senn, Ruti, Switzerland

[73] Assignee: Sulzer Brothers Limited, Winterthur, Switzerland

[21] Appl. No.: 947,623

[22] Filed: Dec. 30, 1986

[30] Foreign Application Priority Data

Jan. 13, 1986 [CH] Switzerland ..... 00095/86

[51] Int. Cl.[4] ..... D03D 51/20

[52] U.S. Cl. ..... 139/369

[58] Field of Search ..... 139/114, 115, 358, 369

[56] References Cited

U.S. PATENT DOCUMENTS 2,507,828 5/1950 Stephensen et al. ..... 139/114

3,584,659 6/1971 Pfarrwaller ..... 139/369

4,193,428 3/1980 Demuth ..... 139/114

4,240,471 12/1980 Rotrekl et al. ..... 139/114

*Primary Examiner*—Henry S. Jaudon

*Attorney, Agent, or Firm*—Kenyon & Kenyon

[57] ABSTRACT

The warp yarn tensioner and warp yarn stop motion are mounted on a supporting and adjusting device of the loom so as to be adjustable together. The supporting and adjusting device includes a tube on which the tensioner and stop motion are mounted via support arms and cantilever beams. The support tube is adjusted relative to the loom frame by a single adjusting mechanism having an adjusting spindle which can be rotated in order to cause rotation of the tube. The warp yarn tensioner and warp yarn stop motion can be pivoted together about the axis of the support tube. The stop motion may also be adjusted vertically by means of a supporting device and can be pivoted about a pivot by means of a separate adjusting spindle.

9 Claims, 3 Drawing Sheets

LOOM HAVING A SUPPORTING AND ADJUSTING DEVICE FOR WARP YARN GUIDANCE

Figure 1:
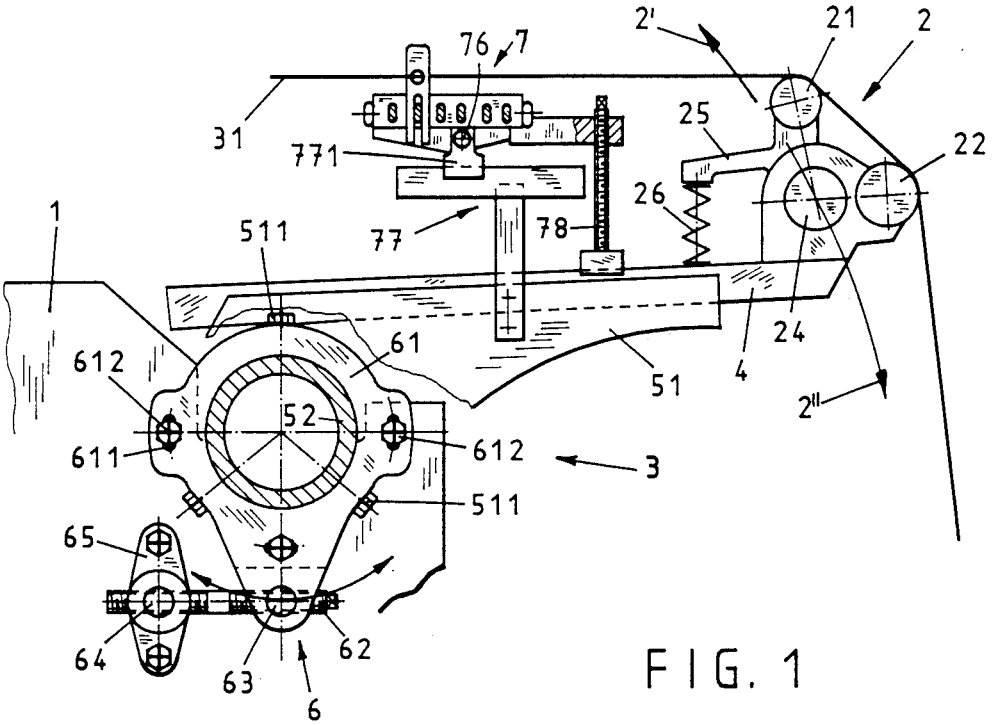

This invention relates to a loom. More particularly, this invention relates to a loom having a supporting and adjusting device for warp yarn guidance.

Heretofore, various types of looms have been provided with various types of warp yarn guidance, for example, in the form of warp yarn tensioners or warp yarn deflecting elements or a warp yarn stop motion. As described in European patent application No. 0109472, devices of this kind can be carried on a plurality of supports which are disposed in a loom frame and which can be moved vertically relative to the individual supports by means of adjusting spindles. However, one problem with such a known device is that each adjusting element must be adjusted independently of the others. Hence, errors of adjustment may occur when the loom is being operated by unskilled operatives. In turn, any misadjustment may lead to the complete device becoming strained, with detriment to the operation and working life of the device. Further, considerable time is consumed in adapting different adjusting elements to one another when the device is adjusted. Hence, the profitability of the loom can be impaired.

Accordingly, it is an object of the invention to provide a supporting and adjusting device for a loom which can be operated rapidly and simply and which can be adjusted accurately.

It is another object of the invention to be able to perform adjustments in the warp guidance of a loom in a simple accurate manner.

It is another object of the invention to reduce the number of adjustments required to adjust the warp guidance elements in a loom.

Briefly, the invention provides a loom having a frame with a support element which is rotatably mounted in the frame, a supporting and adjusting device for warp guidance which is mounted on the support element and means for adjustably fixing the support element to the frame.

The support element may be in the form of a tube which is rotatably mounted in and which extends across the loom frame about a pivot axis. The means for adjustably fixing this tube is in the form of a single adjusting mechanism. For example, the adjusting mechanism may include an adjusting flange which is connected to the tube and which is adjustably secured to the frame as well as an adjusting spindle which is rotatably secured to the flange and fixed relative to the frame for pivoting the flange in response to rotation of the spindle.

When an adjustment is to be made in the supporting and adjusting device for warp yarn guidance, the adjusting spindle can be simply rotated so as to cause rotation of the tube about the pivot axis and correspondingly a pivoting of the supporting and adjusting device.

As compared to previously known devices which utilize a plurality of adjusting elements, the time required for adjustment is considerably reduced. In this respect, a loom operative need only concentrate on a single adjusting mechanism and can therefore carry out adjustments more rapidly and more accurately than on a loom having a plurality of adjusting elements.

Figure 3:
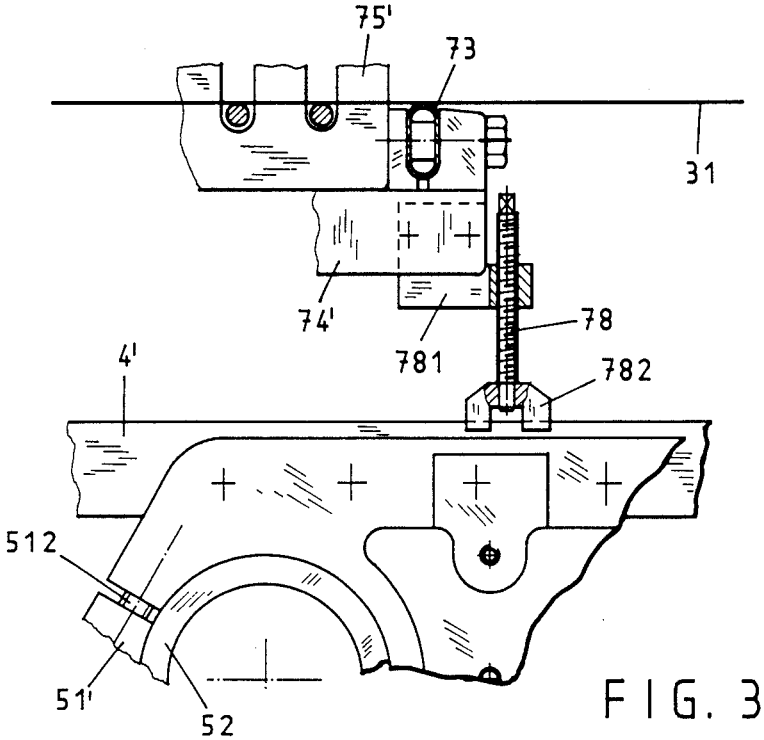
Figure 2A:
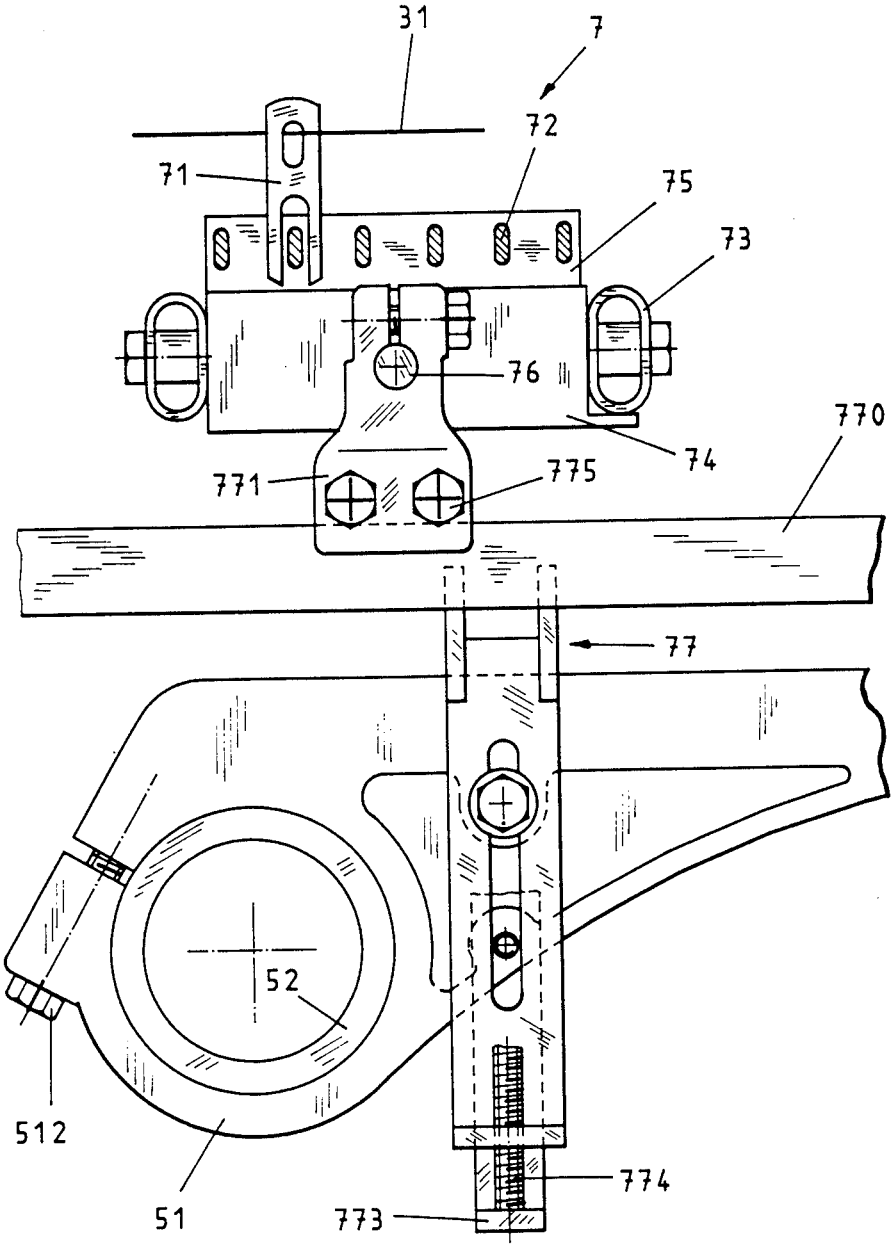
Figure 2B:
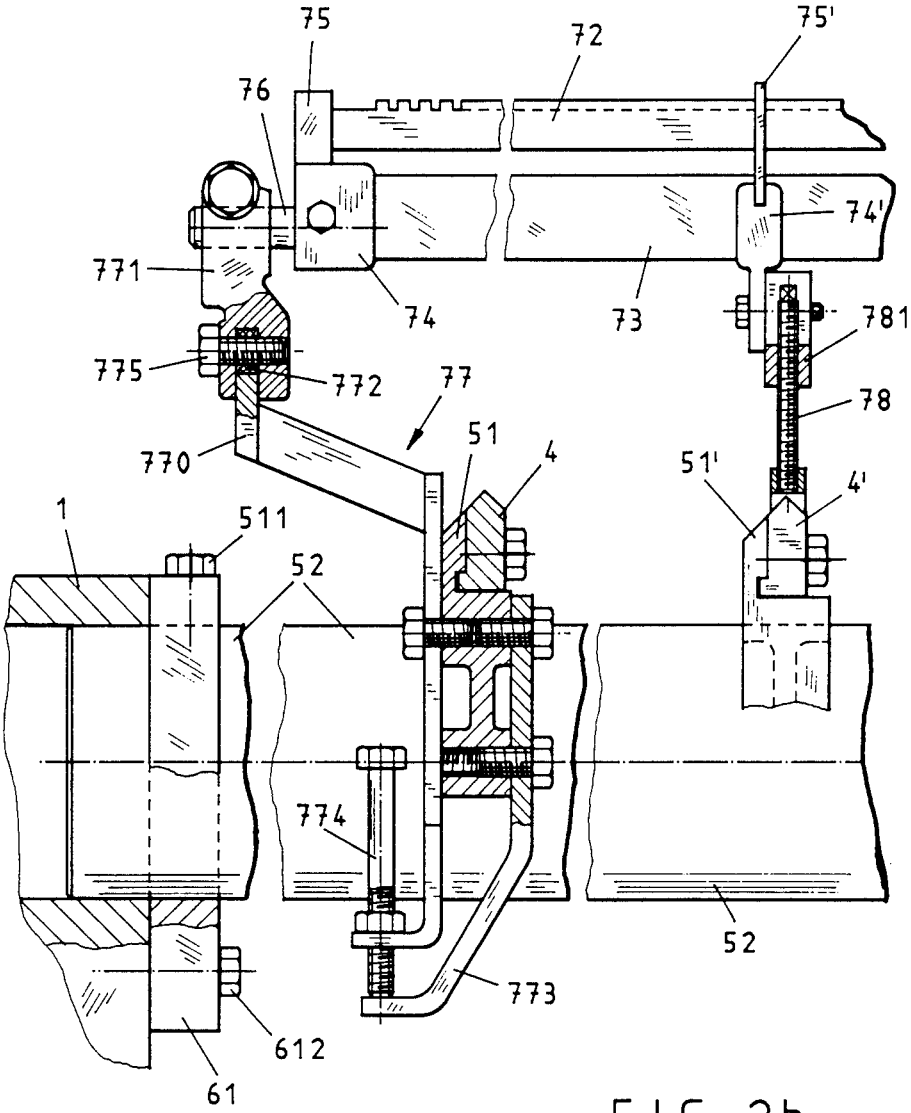

These and other objects and advantages of the invention will become more apparent from the following detailed description taken in conjunction with the accompany drawings wherein:

FIG. 1 illustrates a partial side view of a loom constructed in accordance with the invention;

FIG. 2*a* illustrates a view to an enlarged scale of a supporting and adjusting device including a warp yarn stop motion in accordance with the invention;

FIG. 2*b* illustrates a partial front view of the supporting and adjusting device constructed in accordance with the invention; and FIG. 3 illustrates an intermediate mounting for a warp yarn stop motion in accordance with the invention.

Referring to FIG. 1, the loom includes a frame 1, a support element in the form of a hollow tube 52 which is rotatably mounted in and which extends across the frame 1 about a pivot axis and a supporting and adjusting device 3 for warp yarn guidance mounted on the tube 52. In addition, a means is provided for adjustably fixing the tube 52 to the frame 1. As indicated, this means includes a single adjusting mechanism having an adjusting flange 61 connected to the tube 52 by means of screws 511. In addition, the adjusting flange 61 is adjustably secured to the frame 1 by means of screws 612, each of which passes through a slot 611 in the flange 61 in accordance with the range of adjustment of the supporting and adjusting device 3. The adjusting mechanism also includes an adjusting spindle 62 which is rotatably secured to the flange 61 via an adjusting nut 63 in or on the flange 61 while being fixed to the frame 1 by means of a spindle nut 64 rotatably mounted in a spindle flange 65. As indicated, the spindle flange 65 is bolted to the frame 1. The screw threads on the spindle 62 and the screw threads of the nuts 63, 64 are of opposite hand.

If sufficiently rigid, the tube 52 can be mounted in the frame 1 so as to rotate freely. Otherwise, the tube 52 is secured to an adjusting flange 61 at each of two opposite ends, i.e. to the side upright of the loom frame 1.

A plurality of support arms 51, 51' are secured to the tube 52 in parallel relation. Further, these support arms 51, 51' are distributed over the width of the loom and are secured by grub screws 512 to the tube as indicated in each of FIGS. 2*a* and 2*b*. In addition, a plurality of beams 4, 4' are secured to the respective support arms 51, 51' in cantilever relation.

As shown in FIG. 1, a warp yarn tensioner 2 is supported at the ends of the beams 4, 4'. This tensioner includes a deflecting beam 22 and a tensioning beam 21 which is carried on a number of pivotal levers 25. Each lever 25 is biased by a spring 26 which is located between a beam 4 and the lever 25 in order to pivot the lever about the axis of a support beam 24 against the force applied by the warp yarns 31. Alternatively, any other suitable form of warp tensioning means may be secured to the beams 4, 4'.

As indicated by the arrows 2', 2'', the warp tensioner 2 is adjusted by means of the adjusting mechanism 6 by being rotated about the pivot axis of the tube 52. The supporting and adjusting device 3 also includes a warp yarn stop motion 7 which is mounted on a pair of the support arms 51 in vertically adjustable manner. To this end, any commerically available stop motion 7 can be used. As indicated, the stop motion 7 is disposed on at least two supporting devices 77 which can be screwed to two support arms 51 so as to be vertically adjustable. As indicated in FIG. 2*b*, each supporting device 77 is adjustable relative to a support arm 51 by means of a hook 773 which is secured on one side of the arm 51 and an adjusting spindle 774 which is rotatable relative to the hook 773 while being threaded relative to the supporting device 77.

As indicated, the stop motion 7 is threaded fast to bars 770 by means of at least two clamping members 771 in which a pair of clamping screws 775 are threaded. When these clamping screws 775 are not threaded tight, the stop motion 7 can easily be moved along the bars 770 via slide block 772.

The stop motion 7 also has a pivot 76 mounted in mountings 74 which are connected to tubes 73 (see FIG. 2*a*) and which carry holders 75 for contact rods or bars 72. In the event of a breakage of the warp yarns 31, the bars 72 circuit as is known. The tube 73 also carry mountings 74', on which a plurality of bar holders 75' are distributed over the weaving width. As indicated in FIG. 2*b*, a spindle holder 781 is threaded to at least one mounting 74' while an adjusting spindle 78 is rotatably disposed within the holder 781 to bear by way of a slide block 782 on a beam 4'. Rotation of the spindle 78 serves to pivot the stop motion 7 about the pivot 76 (see FIG. 1).

With the above adjustment features, the stop motion 7 can be adapted to any position of the wrap yarns 31. In this respect, the stop motion 7 may be slide back and forth along the bars 770 and may be pivoted about the pivot 76.

Of not, other facilities such as shaft guides or twisting heads may also be mounted on the tube 52. Conveniently, an adjusting scale may also be provided on a loom upright or on an adjusting flange in order to assist in accurate adjustment of the supporting and adjusting device 3.

The invention thus provides a rather simple supporting and adjusting device for warp yarn guidance in a loom which can be accurately adjusted in rapid manner. In this respect, the invention provides a single adjusting mechanism which can be conveniently located in order to adjust various warp tensioning and warp monitoring devices simultaneously.

What is claimed is:

1. In a loom, the combination comprising
a frame;
a support element rotatably mounted in said frame;
a supporting and adjusting device for warp yarn guidance mounted on said support element; and
a single adjusting mechanism for adjustably fixing said support element to same frame, said adjusting mechanism including an adjusting flange connected to said support element and adjustably secured to said frame and an adjusting spindle rotatably secured to said flange and fixed to said frame for pivoting said flange in response to rotation of said spindle.

2. The combination as set forth in claim 1 which further comprises a plurality of support arms secured to said support element and a plurality of beams, each beam being connected in cantilever relation to a respective support arm, said supporting and adjusting device including a warp yarn tensioner supported on said beams.

3. The combination as set forth in claim 2 wherein said means includes an adjusting flange integral with one of said support arms and connected to said support element and an adjusting spindle rotatably secured to said flange and fixed to said frame for pivoting said flange in response to rotation of said spindle.

4. The combination as set forth in claim 2 wherein said supporting and adjusting device includes a warp yarn stop motion mounted on a pair of said support arms in vertically adjustable manner, a pivot pivotally supporting said stop motion and, a threaded spindle secured between said stop motion and one of said beams for pivoting said stop motion on said pivot.

5. In a loom, the combination comprising
a frame;
a tube rotatably mounted in and extending across said frame about a pivot axis;
a supporting and adjusting device for warp yarn guidance mounted on said tube; and
means for adjusting fixing said tube to said frame relative to said axis, said means including a flange connected to said tube and adjustably secured to said frame and an adjustable spindle rotatably secured to said flange and fixed to said frame for pivoting said flange in response to rotation of said spindle.

6. The combination as set forth in claim 5 wherein said device includes a plurality of support arms secured to said tube for rotation therewith, a plurality of beams, each said beam being secured to a respective arm in cantilever relation, a warp yarn tensioner supported on said beams and a warp stop motion mounted on said arms.

7. The combination as set forth in claim 6 which further comprises means for mounting said warp stop motion on two of said support arms in vertically adjustable manner.

8. The combination as set forth in claim 7 which further comprises a pivot pivotally supporting said stop motion and a threaded spindle between said warp stop motion and one of said beams for pivoting said stop motion about said pivot.

9. In a loom, the combination comprising
a frame;
a support element rotatably mounted in said frame;
a plurality of support arms secured to said support element;
a plurality of beams, each beam being connected in cantilever relation to a respective support arm;
a supporting and adjusting device for warp yarn guidance mounted on said support element and including a warp yarn tensioner supported on said beams; and
means for adjustably fixing said support element to said frame, said means including an adjusting flange integral with one of said support arms and connected to said support element and an adjusting spindle rotatably secured to said flange and fixed to said frame for pivoting said flange in response to rotation of said spindle.

* * * * *

UNITED STATES PATENT AND TRADEMARK OFFICE

CERTIFICATE OF CORRECTION

PATENT NO. : 4,754,784

DATED : July 5, 1988

INVENTOR(S) : Georg Senn

It is certified that error appears in the above-identified patent and that said Letters Patent is hereby corrected as shown below:

Column 2, line 2 "ac-company" should be -ac-companying-
Column 3, line 16 "tube" should be -tubes-
Column 3, line 16 "72 circuit" should be -72 act by way of lamellae 71 to close an electrical switching circuit-
Column 3, line 27 "slide" should be -slid-
Column 3, line 30 "not" should be -note-
Column 4, line 22 "adjusting" should be -adjustably- Signed and Sealed this Twenty-ninth Day of November, 1988

*Attest:*

DONALD J. QUIGG

*Attesting Officer*

*Commissioner of Patents and Trademarks*